US005817985A

United States Patent [19]

Bonds

[11] Patent Number: 5,817,985

[45] Date of Patent: Oct. 6, 1998

[54] CONDUCTOR PAD

[75] Inventor: Robert S. Bonds, Avon Lake, Ohio

[73] Assignee: Helical Line Products Co., Avon Lake, Ohio

[21] Appl. No.: 600,540

[22] Filed: Feb. 13, 1996

Related U.S. Application Data

[63] Continuation of Ser. No. 395,662, Apr. 3, 1995, abandoned, which is a continuation of Ser. No. 44,970, Apr. 8, 1993, abandoned.

[51] Int. Cl.[6] ..... H01B 17/00

[52] U.S. Cl. ..... 174/172; 174/154; 174/168

[58] Field of Search ..... 174/168, 172, 174/173, 174, 135, 136, 147, 154, 166 R, 163 R, 169, 156, 175

[56] References Cited

U.S. PATENT DOCUMENTS

| | | | |
|---|---|---|---|
| 319,300 | 6/1885 | Morton | 174/154 X |
| 544,959 | 8/1895 | Collins et al. | 174/172 |
| 609,888 | 8/1898 | Leonard | 174/172 |
| 1,547,220 | 7/1925 | Kipp | 174/136 |
| 4,409,432 | 10/1983 | Willem et al. | 174/172 |

FOREIGN PATENT DOCUMENTS

| | | | |
|---|---|---|---|
| 0219496 | 5/1957 | Australia | 174/173 |
| 0982103 | 12/1982 | U.S.S.R. | 174/173 |

*Primary Examiner*—Hyung S. Sough
*Attorney, Agent, or Firm*—Tarolli, Sundheim, Covell, Tummino & Szabo

[57] ABSTRACT

An electrical conductor cable extends in a longitudinal direction. An insulator member has a bearing surface portion convexly curved in the longitudinal direction and concavely curved in a direction transverse to the longitudinal direction. A pad is located between the bearing surface portion of the insulator member and the conductor cable. The pad has a conductor engaging surface engaged by the conductor cable. The pad has a preformed surface in contact with the bearing surface portion of the insulator member. The preformed surface of the pad is concavely curved in the longitudinal direction and convexly curved in a direction transverse to the longitudinal direction and provides an area of contact between the preformed surface and the bearing surface portion of the insulator member.

11 Claims, 2 Drawing Sheets

CONDUCTOR PAD

This is a continuation of applicarion Ser. No. 08/395,662 filed on Apr. 13, 1995 which is a Continuation of Ser. No. 08/044,970 filed Apr. 8, 1993, now both abandoned.

TECHNICAL FIELD

The present invention relates to securing an electrical conductor cable to an insulator member, and is particularly directed to a protective cushioning pad for location between the electrical conductor cable and the insulator member.

BACKGROUND ART

Many devices are known for securing an electrical conductor cable to an insulator member. One known device is a line tie which is usually wrapped around portions of the conductor cable and the insulator member. Typically, the cable lies in a groove in the insulator member. The groove is convexly curved in the direction of cable extent and is concavely curved in the direction transverse to the cable extent. A protective cushioning pad is often located between the conductor cable and the insulator member to protect the conductor and the insulator member from abrasion when the conductor cable vibrates or oscillates due to wind and other environmental forces to which it is subjected. The pad is made of a resilient rubber-like material. The pad has a contact surface which engages a corresponding contact surface defining the groove in the insulator member. The contact surfaces have, in general, a line contact. As a result, the contact surface of the pad wears relatively quickly due to the vibration or oscillations of the conductor cable.

SUMMARY OF THE INVENTION

The present invention is directed to an apparatus for use with an electrical conductor cable which extends in a given direction and an insulator member having a bearing surface portion which is convexly curved in the direction of cable extent and is concavely curved in a direction transverse to the direction of cable extent. The apparatus comprises a pad for location between the bearing surface portion of the insulator member and the electrical conductor cable. The pad has a conductor engaging surface for engagement by the electrical conductor cable. Preferably, the pad is made of a rubber-like material.

The pad has a preformed surface in contact with the bearing surface portion of the insulator member. The preformed surface provides an area of contact between the preformed surface and the bearing surface portion prior to the electrical conductor cable engaging the conductor engaging surface of the pad. The preformed surface is concavely curved in the direction of cable extent and convexly curved in a direction transverse to the direction of cable extent. The preformed surface of the pad is convexly curved at a radius approximately equal to the radius of curvature of the concavely curved bearing surface portion of the insulator member.

In a first embodiment of the present invention, the preformed surface of the pad is, preferably, concavely curved at a radius approximately equal to the radius of curvature of the convexly curved bearing surface portion of the insulator member. In a second embodiment of the present invention, the preformed surface of the pad is concavely curved at a radius slightly less than the radius of curvature of the convexly curved bearing surface portion of the insulator member prior to the preformed surface of the pad contacting the bearing surface portion of the insulator member. In a third embodiment of the present invention, the size of the pad is smaller than the size of the pad in the first embodiment. The preformed surface of the smaller pad is concavely curved at a radius approximately equal to the radius of curvature of the convexly curved bearing surface of the insulator member.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
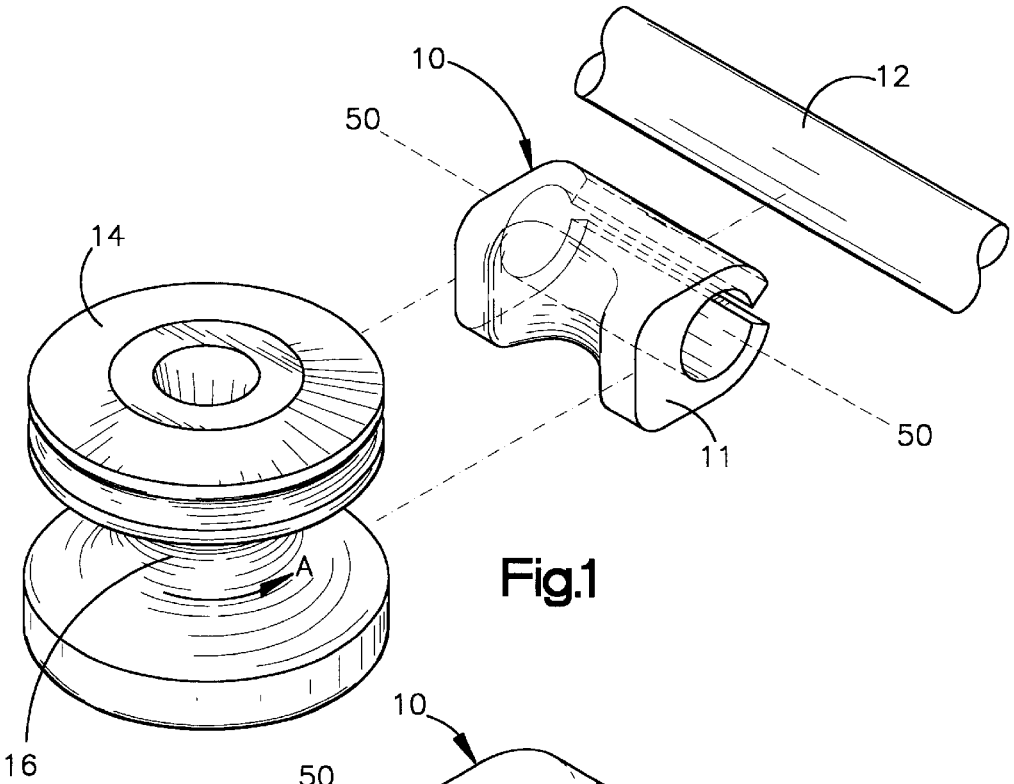
FIG. 1 is an exploded perspective view of a conductor pad located between an electrical conductor cable and an insulator member and constructed in accordance with the present invention.

The present invention is directed to an apparatus for use with an electrical conductor cable and an insulator member to which the electrical conductor cable may be secured. The specific construction of the apparatus may vary. As illustrated in the exploded view of FIG. 1, an apparatus 10 constructed in accordance with the present invention is in the form of a pad 10 located between an electrical conductor cable 12 and an insulator member 14 having a bearing surface portion 16.

Figure 2:
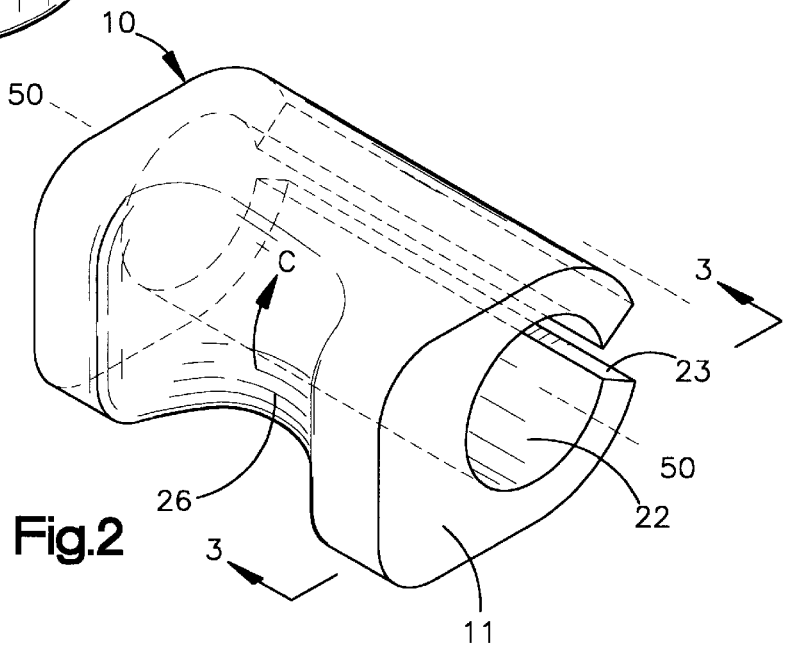
FIG. 2 is an enlarged view of the conductor pad in FIG. 1.
Figure 3:
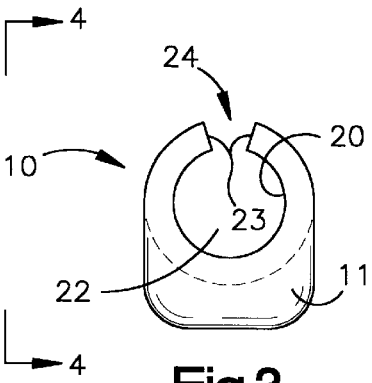
FIG. 3 is an end view taken in the direction of line 3—3 of FIG. 2.
Figure 4:
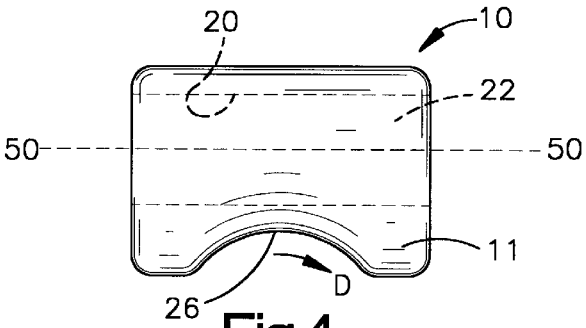
FIG. 4 is a view taken in the direction of line 4—4 of FIG. 3.

Referring to FIGS. 2–4, the pad 10 includes a body 11 having a conductor engaging cylindrical surface 20 which defines a cylindrical linear passage 22 for receiving the conductor cable 12. The linear passage 22 extends through the body 11. The linear passage 22 has a longitudinal axis 50 along which the conductor cable 12 extends when the conductor cable 12 is received in the linear passage 22.

The pad 10 is made of a suitable rubber-like resilient material. The pad 10 has a pair of longitudinally extending inner edge faces 23 which face each other at a slight angle relative to each other. A longitudinally extending slot 24 is defined between the pair of inner edge faces 23. Due to the resilient nature of the pad 10, the width of the slot 24 can be enlarged to locate the pad 10 on the conductor cable 12 with the conductor cable 12 extending through the linear passage 22.

Figure 5:
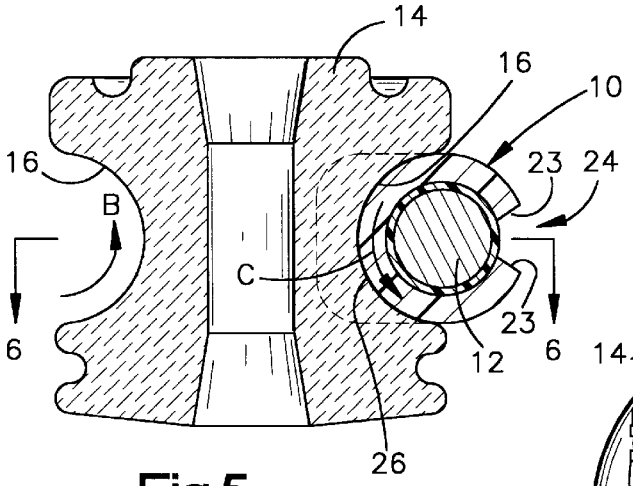
FIG. 5 is a sectional view showing parts assembled.
Figure 6:
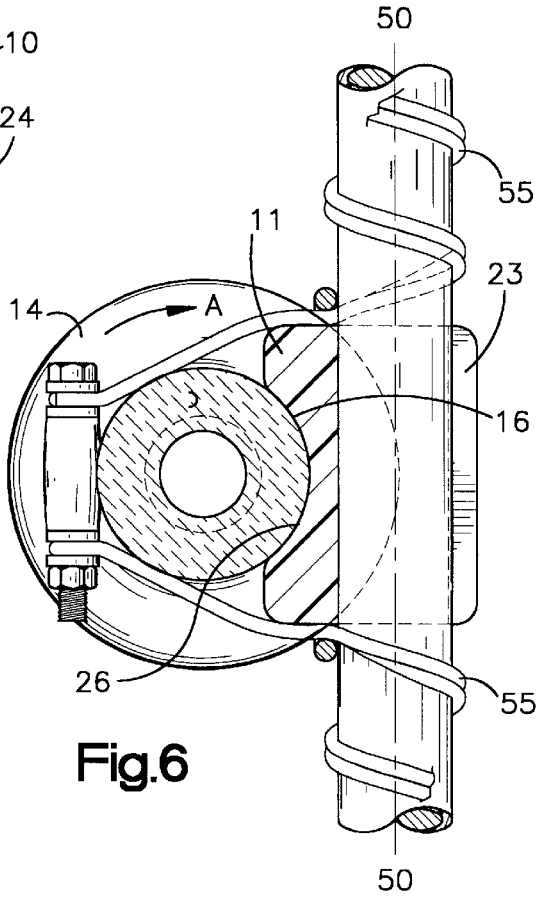
FIG. 6 is a sectional view taken approximately along line 6—6 in FIG. 5.

Referring to FIGS. 5 and 6, the pad 10, the conductor cable 12, and the insulator member 14 are shown assembled together. To assemble the pad 10, the conductor 12, and the insulator member 14 together, as shown in FIGS. 5 and 6, the pad 10 is first located on the conductor cable 12 with the conductor cable 12 extending through the linear passage 22. This is accomplished by enlarging the slot 24 in the pad 10 and manipulating the pad 10 around the conductor cable 12 until the conductor cable 12 is received in the linear passage 22 and extends through the linear passage 22 along the longitudinal axis 50, as shown in FIG. 6. As viewed in FIG. 5, the longitudinal axis 50 extends out of the page.

After the conductor cable 12 is received in the linear passage 22, the pad 10 is brought into contact with the insulator member 14 and is then secured to the insulator member 14 using suitable means such as line ties 55 (shown only in FIG. 6). More specifically, the pad 10 has a preformed surface 26 which is in contact with the bearing surface portion 16 of the insulator member 14 when the pad 10 and the insulator member 14 are assembled together as shown in FIGS. 5 and 6. The preformed surface 26 is an outer surface of the body 11 which is curved relative to the linear passage 22. The preformed surface 26 provides an area of contact between the preformed surface 26 and the bearing surface portion 16 of the insulator member 14 when the pad 10 and the insulator member 14 are assembled together.

The bearing surface portion 16 of the insulator member 14 is convexly curved, as shown by arrow A in FIGS. 1 and 6, in the direction of cable extent of the conductor cable 12 and in the direction of axis 50. The bearing surface portion 16 of the insulator member 14 is concavely curved, as shown by arrow B in FIG. 5, in a direction which is transverse to the direction of cable extent of the conductor cable 12 and the axis 50.

The preformed surface 26 of the pad 10 has a contour shape which is complementary to the contour shape of the bearing surface portion 16 of the insulator member 14. The preformed surface 26 of the pad 10 is convexly curved, as shown by arrow C in FIG. 2, in a direction which is transverse to the direction of cable extent of the conductor cable 12 and the axis 50. Preferably, the preformed surface 26 is convexly curved, as shown by arrow C in FIG. 2, at a radius approximately equal to the radius of curvature of the concavely curved bearing surface portion 16 of the insulator member 14, as shown by arrow B in FIG. 5. The preformed surface 26 of the pad 10 is concavely curved, as shown by arrow D in FIG. 4, in the direction of cable extent of the conductor cable 12 and in the direction of axis 50.

In a first embodiment of the present invention, the preformed surface 26 is concavely curved, as shown by arrow D in FIG. 4, at a radius approximately equal to the radius of curvature of the convexly curved bearing surface portion 16 of the insulator member 14, as shown by arrow A in FIG. 5. When the radii are approximately equal and the preformed surface 26 engages the bearing surface portion 16 as shown in FIG. 6, the contour shape of the concave curvature of the preformed surface 26, as shown by arrow D in FIG. 4, conforms exactly to the contour shape of the convex curvature of the bearing surface portion 16, as shown by arrow A in FIG. 6. By providing the preformed surface 26 of pad 10 with a curvature which matches the curvature of the bearing surface portion 16 of the insulator member 14, wear on the pad 10 is reduced resulting in substantially longer life of the pad 10. Tests have shown that the life of the pad 10 is increased by at least ten times over pads known in the prior art.

Figure 7:
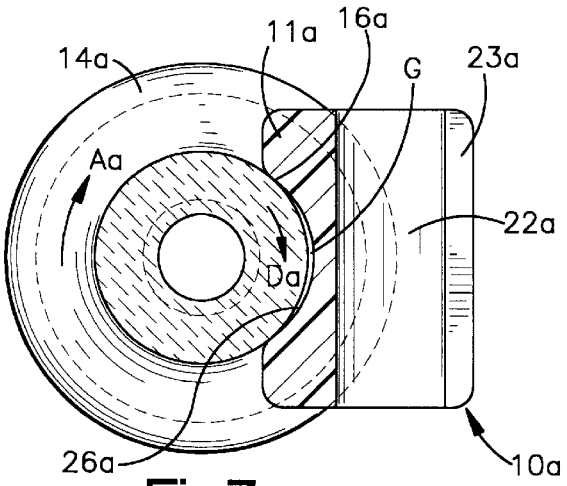
FIG. 7 is a view similar to FIG. 6 with certain parts removed and showing a second embodiment of the present invention.

A second embodiment of the present invention is illustrated in FIG. 7. Since the embodiment of the invention illustrated in FIG. 7 is generally similar to the embodiment of the invention illustrated in FIG. 6, similar numerals are utilized to designate similar components, the suffix letter "a" being associated with the embodiment of FIG. 7 to avoid confusion. To better explain the embodiment of the invention illustrated in FIG. 7, the pad 10*a* is shown without any electrical conductor cable received in the liner passage 22*a* and therefore without any line ties which would secure an electrical conductor cable to the insulator member 14*a*.

The body 11*a* of the pad 10*a* is shown in FIG. 7 as being located adjacent the insulator member 14*a* in which the preformed surface 26*a* of the pad 10*a* lies adjacent without any pressure against the bearing surface portion 16*a* of the insulator member 14*a*. The preformed surface 26*a* of the pad 10*a* is concavely curved, as shown by arrow Da in FIG. 7, at a radius slightly less than the radius of curvature of the convexly curved bearing surface portion 16*a* of the insulator member 14*a*, as shown by arrow Aa in FIG. 7. When the radii are not equal and the preformed surface 26*a* lies adjacent without any pressure against the bearing surface portion 16, the contour shape of the concave curvature of the preformed surface 26*a*, as shown by arrow Da in FIG. 7, does not conform exactly to the contour shape of the convex curvature of the bearing surface portion 16*a*, as shown by arrow Aa in FIG. 7. A small gap G is thus formed between the preformed surface 26*a* and the bearing surface portion 16*a*, as shown in FIG. 7.

However, even though the radii are not equal, it is contemplated that the contour shape of the concave curvature of the preformed surface 26*a*, as shown by arrow Da in FIG. 7, will conform exactly to the contour shape of the convex curvature of the bearing surface portion 16*a*, as shown by arrow Aa in FIG. 7, when an electrical conductor cable (not shown in FIG. 7) is received in the linear passage 22*a* and line ties (also not shown in FIG. 7) are used to secure the conductor cable to the insulator member 14*a*. When a conductor cable is secured to the insulator member 14*a*, the preformed surface 26*a* of the pad 10*a* is pressed towards the bearing surface portion 16*a* of the insulator 14*a* until the preformed surface 26*a* engages the bearing surface portion 16*a*. When the preformed surface 26*a* engages the bearing surface portion 16*a*, the contour shape of the concave curvature of the preformed surface 26*a*, as shown by arrow Da in FIG. 7, conforms exactly to the contour shape of the convex curvature of the bearing surface portion 16*a*, as shown by arrow Aa in FIG. 7.

Figure 8:
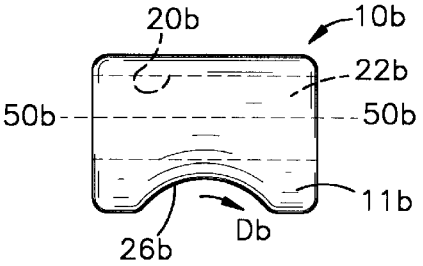
FIGS. 8 and 9 are views similar to the views of FIGS. 4 and 5, respectively, and showing a third embodiment of the present invention.
Figure 9:
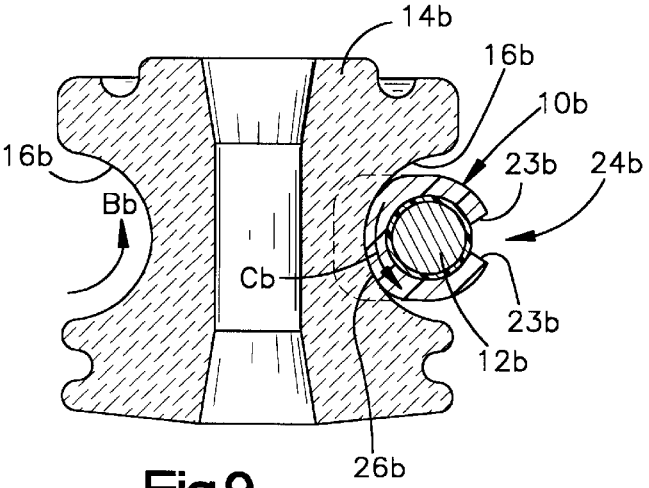

A third embodiment of the present invention is illustrated in FIGS. 8 and 9. Since the embodiment of FIGS. 8 and 9 is generally similar to the embodiment of the invention illustrated in FIGS. 4 and 5, similar numerals are utilized to designate similar components, the suffix letter "b" being associated with the embodiment of FIGS. 8 and 9 to avoid confusion.

The size of the pad 10*b* shown in the embodiment of FIGS. 8 and 9 is smaller than the size of the pad 10 shown in the embodiment of FIGS. 4 and 5. Accordingly, the size of the conductor cable 12*b* shown in the embodiment of FIGS. 8 and 9 is correspondingly smaller than the size of the conductor cable 12 shown in the embodiment of FIGS. 4 and 5. Although the pad 10*b* shown in the embodiment of FIGS. 8 and 9 is relatively smaller, the preformed surface 26*b* is convexly curved, as shown by arrow Cb in FIG. 9, at a radius approximately equal to the radius of curvature of the concavely curved bearing surface portion 16*b* of the insulator member 14*b*, as shown by arrow Bb in FIG. 9. The preformed surface 26*b* of the pad 10*b* is concavely curved, as shown by arrow Db in FIG. 8, at a radius approximately equal to the radius of curvature of the convexly curved bearing surface portion 16*b* of the insulator member 14*b* (arrow not shown in FIGS. 8 and 9).

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. An apparatus comprising:

a linear electrical conductor cable having an axis and extending in a first direction parallel to said axis;

an insulator member disposed adjacent to said conductor cable, said insulator member having a bearing surface portion presented toward said conductor cable, said bearing surface portion being convexly curved in said first direction and concavely curved in a second direction transverse to said first direction; and a protective pad, being of resilient material, for supporting said conductor cable at a location spaced from said insulator member;

said protective pad having a body portion located between, and in abutting engagement with, said conductor cable and with said bearing surface portion of said insulator member;

said pad body portion having a conductor engaging cylindrical surface defining a cylindrical linear passage extending through said protective pad through which said conductor cable is extendable, said cylindrical surface and said conductor cable having an area contact;

said pad body portion having a preformed second surface;

said preformed second surface being concavely curved in said first direction complementary to said convex curvature of said insulator member in said first direction, and said preformed second surface being convexly curved in said second direction complementary to said concave curvature of said insulator member in said second direction, said preformed second surface having an area contact with said bearing surface; and said pad body portion having a pair of inner edge faces extending longitudinally and from said cylindrical linear passage, said inner edge faces defining between them a longitudinally extending slot extending radially between said cylindrical linear passage and an exterior opposite to said preformed second surface of said pad and longitudinally throughout a longitudinal extent of said pad, said longitudinally extending slot having a width that is smaller than the diameter of said conductor cable, the resiliency of said pad enabling selective movement of said inner edge faces away from each other to a position where the width of said longitudinally extending slot is larger than the diameter of said conductor cable so that said conductor cable can be radially displaced through said longitudinally extending slot and into said cylindrical linear passage, said inner edge faces of said pad being movable back toward each other due to the resiliency of said pad thereby blocking relative movement of said conductor cable through said longitudinally extending slot, said pad, when said conductor cable is disposed within said cylindrical linear passage, being movable into a position in engagement with said insulator member in which said preformed second surface of said pad is in engagement with said bearing surface portion of said insulator member.

2. An apparatus as set forth in claim 1 wherein said pad body portion varies substantially in thickness from end to end along the length of said pad.

3. An apparatus as set forth in claim 2 wherein said pad body portion has relatively thick axial end portions which wrap at least partially around said insulator member and has a relatively thin axially central portion disposed intermediate said end portions.

4. An apparatus as set forth in claim 2 wherein said varying thickness is a result of the varying shape of said preformed second surface of said pad body portion, said cylindrical surface of said pad body portion being linear.

5. Apparatus as set forth in claim 1 wherein said preformed second surface of said pad is concavely curved at a radius less than a the radius of curvature of said convexly curved bearing surface portion of said insulator member prior to said preformed second surface of said pad contacting said bearing surface portion of said insulator member.

6. An apparatus for use with a linear electrical conductor cable and an insulator member to which the conductor cable may be secured, the insulator member having a bearing surface portion presented toward the conductor cable which is convexly curved in a first direction and concavely curved in a second direction transverse to the first direction, said apparatus comprising a pad for location on the conductor cable between the conductor cable and the insulator member, said pad comprising:

a body portion having a conductor engaging cylindrical surface which defines a cylindrical linear passage for receiving the conductor cable, said linear passage extending through said body portion;

said linear passage having a longitudinal axis along which the conductor cable extends when the conductor cable is received in said linear passage;

said pad body portion having a preformed second surface for abuttinaly engaging the bearing surface portion of the insulator member, said preformed second surface being concavely curved in a first direction to be complementary to the convex curvature of the insulator member in the first direction, and said preformed second surface being convexly curved in a second direction to be complementary to the concave curvature of the insulator member in the second direction;

said pad being made of a rubber-like resilient material;

said pad having a pair of longitudinally extending inner edge faces which define between them a longitudinally extending slot extending radially between said cylindrical linear passage and an exterior opposite to said preformed second surface of said pad;

said inner edge faces of said pad being resiliently deflectable away from each other from a first condition in which a width of said slot is less than the diameter of the conductor cable to be secured to a second condition in which the width of said slot is greater than the diameter of the conductor cable to be secured to enable passage of the conductor cable through said slot into said linear passage;

said inner edge faces of said pad being resiliently movable toward each other and toward the first condition to locate said pad on the conductor cable with the conductor cable extending through said linear passage in said pad and with said pad extending around the conductor cable, the resilient nature of said pad maintaining said cylindrical surface abuttingly encircling the conductor cable to be secured to retain said pad on the conductor cable and providing an area contact between said pad and the conductor cable to be secured;

said pad when retained on the conductor cable being movable from a first position spaced apart from the insulator member to a second position in abutting engagement with the bearing surface portion of the insulator members.

7. An apparatus as set forth in claim 6 wherein said pad body portion varies substantially in thickness from end to end along the length of said pad.

8. An apparatus as set forth in claim 7 wherein said pad body portion has relatively thick axial end portions for wrapping at least partially around the insulator member and has a relatively thin axially central portion disposed intermediate said end portions.

9. An apparatus as set forth in claim 7 wherein said varying thickness is a result of the varying shape of said preformed second surface of said pad body portion, said cylindrical surface of said pad body portion being linear.

10. Apparatus as set forth in claim 6 wherein said preformed second surface of said pad is concavely curved at a radius less than a radius of curvature of the convexly curved bearing surface portion of the insulator member prior to said preformed second surface of said pad contacting the bearing surface portion of the insulator member.

11. An apparatus for use with a linear electrical conductor cable and an insulator member to which the conductor cable may be secured, the insulator member having a bearing surface portion presented toward the conductor cable which is convexly curved in a first direction and concavely curved in a second direction transverse to the first direction, said apparatus comprising a protective pad displaceable between the conductor cable and the insulator member, said pad comprising:

a body portion made of a resilient material and having a conductor engaging cylindrical surface which defines a cylindrical linear passage for receiving the conductor cable, said linear passage extending through said body portion, said cylindrical surface having an area contact with the conductor cable to be secured;

said pad body portion having a preformed second surface for abuttinaly engaging in an area contact the bearing surface portion of the insulator member, said preformed second surface being concavely curved in a first direction to be complementary to the convex curvature of the insulator member in the first direction, and said preformed second surface being convexly curved in a second direction to be complementary to the concave curvature of the insulator member in the second direction;

said body portion having first means for enabling the conductor to be located in said linear passage, said first means including a longitudinally extending slot extending radially between said cylindrical linear passage and an exterior opposite to said preformed second surface of said body portion, said slot extends throughout the extent of said body portion;

said body portion having a pair of longitudinally extending edge faces which oppose each other and which define said longitudinally extending slot;

said edge faces being resiliently separable away from each other from a first condition in which the width of said longitudinally extending slot is less than the diameter of the conductor cable to be secured to a second condition in which the width of said longitudinally extending slot is greater than the diameter of the conductor cable to be secured to enable relative radial displacement of said body portion onto the conductor cable by relative movement of the conductor cable through said longitudinally extending slot into said cylindrical linear passage;

said edge faces being resiliently drawn towards each other from said second condition toward said first condition returning a width of said longitudinally extending slot to a diameter less than the diameter of the conductor cable to be secured to prevent radial displacement of the conductor cable through said longitudinal extending slot out of said cylindrical linear passage.

* * * * *